United States Patent [19]

Toki et al.

[11] Patent Number: 4,773,361

[45] Date of Patent: Sep. 27, 1988

[54] OVERHEAD CAM TYPE FOUR-VALVE ACTUATING APPARATUS FOR INTERNAL COMBUSTION ENGINE

[75] Inventors: Susumu Toki; Takeshi Iwata; Noriaki Fujii, all of Saitama, Japan

[73] Assignee: Honda Giken Kogyo Kabushiki Kaisha, Tokyo, Japan

[21] Appl. No.: 893,951

[22] Filed: Aug. 7, 1986

[30] Foreign Application Priority Data

Aug. 8, 1985 [JP] Japan ..... 60-174588

[51] Int. Cl.[4] ..... F01L 1/26

[52] U.S. Cl. ..... 123/90.23; 123/90.4

[58] Field of Search ..... 123/90.27, 90.6, 90.22, 123/90.23, 90.4, 90.41, 90.44

[56] References Cited

U.S. PATENT DOCUMENTS

| | | | |
|---|---|---|---|
| 2,024,334 | 12/1935 | Caminez | 123/90.4 |
| 4,267,811 | 5/1981 | Springer | 123/90.27 |
| 4,553,515 | 11/1985 | King et al. | 123/90.4 |
| 4,558,667 | 12/1985 | Inagaki et al. | 123/90.22 |
| 4,621,597 | 11/1986 | Kawada et al. | 123/90.44 |

FOREIGN PATENT DOCUMENTS

| | | | |
|---|---|---|---|
| 96406 | 6/1984 | Japan | 123/90.4 |

*Primary Examiner*—Charles J. Myhre
*Assistant Examiner*—David A. Okonsky
*Attorney, Agent, or Firm*—Lyon & Lyon

[57] ABSTRACT

An OHC type internal combustion engine with four valves per cylinder in which a single cam shaft extending longitudinally is engaged by individual rocker arms for each valve for pivoting those rocker arms to actuate the valves. The pairs of exhaust valves on one side of the engine are actuated by rocker arms mounted on a continuous rocker arm shaft. The intake valve rocker arms are mounted on a plurality of short shafts supported by their ends. A cam shaft holder is positioned over each cylinder and they serve to rotatably support the cam shaft, support the continuous rocker arm shaft, support the ends of the plural rocker arm short shafts, and to permit access to the spark plug for that cylinder. The spark plug has its electrodes located at the center of the combustion chamber and is inclined outwardly for access from between the intake valve rocker arms for that cylinder.

16 Claims, 4 Drawing Sheets

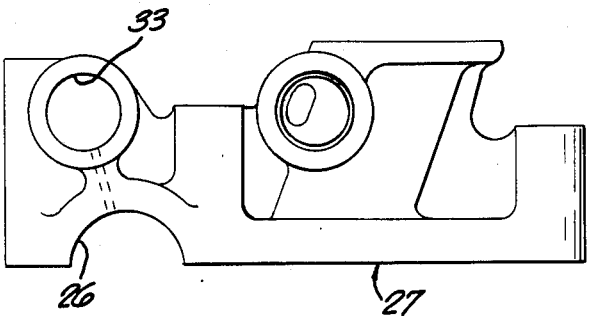
FIG. 8.
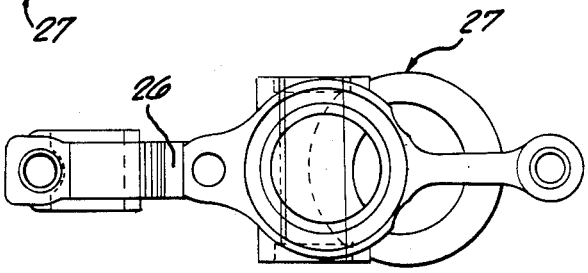
FIG. 9.
4,773,361
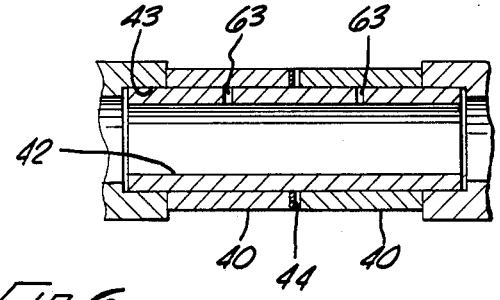
FIG. 7.
FIG. 6.
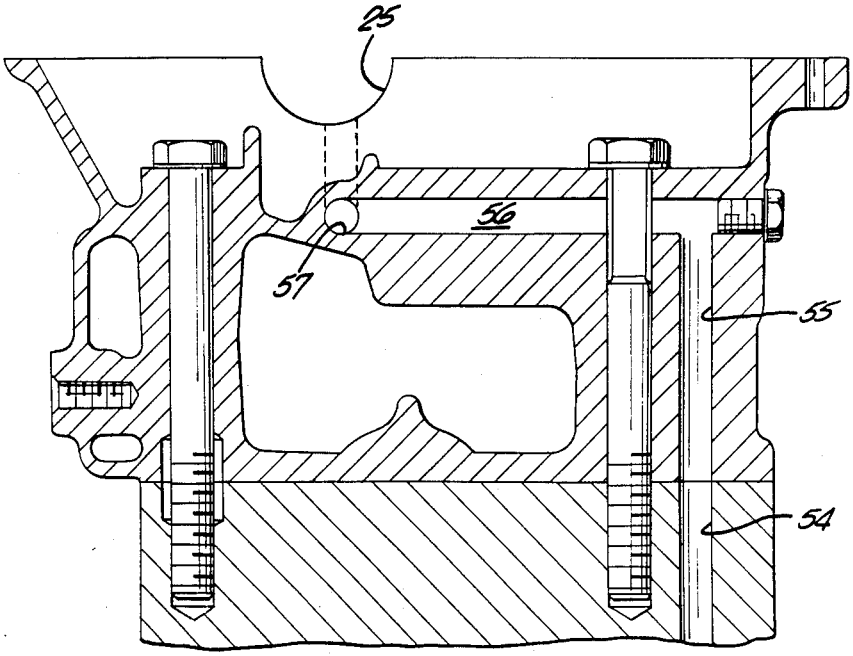

OVERHEAD CAM TYPE FOUR-VALVE ACTUATING APPARATUS FOR INTERNAL COMBUSTION ENGINE

This invention relates to an overhead cam ("OHC") type valve actuating apparatus for a four-valve type internal combustion engine having a pair of intake valves on one side of each cylinder and a pair of exhaust valves on the other side of each cylinder.

There are various arrangements of valve operating apparatus in a OHC type internal combustion engines, such as, dual cams with each cam positioned over a row of valves for directly actuating those valves or positioned to one side with rocker arms for indirectly actuating those valves, or a single cam with rocker arms for actuating one or both rows of valves indirectly. An arrangement using rocker arms has the advantage of ready access to the valve lifter adjusting devices but requires rocker arm pivotal supports, either rocker shafts or individual supports for each rocker arm, and therefore the number of components required normally increases and the space becomes crowded. This is particularly true of an OHC internal combustion engine having four main valves per cylinder.

Another factor to consider in the design of an internal combustion engine is that it is desirable for the electrodes of the spark plug to be disposed centrally in the ceiling of the combustion chamber in order to propagate the combustion flame of the fuel-air mixture induced by the spark discharge of the spark plug throughout the whole area rapidly and evenly from the center of the combustion chamber to all the marginal portions to thereby prevent knocking and improve the combustion efficiency.

However, as noted above, in conventional OHC type valve actuating devices in four-valve internal combustion engines, the space is very crowded since at least one valve actuating cam shaft is rotatably supported in the cylinder head and normally separate intake and exhaust rocker arm shafts or support means are fixed on both sides of the valve actuating cam shaft with intake and exhaust rocker arms pivotably mounted on those rocker arm shafts thereby interconnecting the intake and exhaust valve actuating cams on the valve actuating cam shaft to the intake and exhaust valves. Therefore, the space above the central part of the combustion chamber is occupied by a number of valve actuating members leaving very little space available for positioning the electrodes of the spark plug centrally in the combustion chamber and for easily installing and removing the spark plug. Consequently, it has heretofore been necessary to dispose the spark plug in a position to one side of the combustion chamber adjacent the valve actuating members or at least substantially inclined to one side. However, the installation and removal of the spark plug is still difficult and the numerous components of the valve actuating device causes the apparatus to become very large. Further, the reduction in space caused by the spark plug creates a problem for properly supporting the rocker arms on that side of the engine.

Moreover, since the OHC valve actuating apparatus includes numerous moving components that must be lubricated such as bearing portions for supporting the rotation of the valve actuating cam shaft, the rocking support portions for the rocker arms, and the interengagement between the cams and the rocker arms, the oil supply system for forcibly supplying oil to all those components is extremely important and can become complicated in construction, thus leading to increases in cost. Further, because of the need for an effective oil supply system, the components of the valve actuating mechanism are restricted to some degee in their arrangement and mounting, which is an obstacle to having a more compact valve actuating mechanism.

Thus, it is an object of the present invention to provide a valve actuating apparatus for a OHC type four-valve internal combustion engine in which the spark plug can be disposed centrally in the combustion chamber and easily installed and removed, and in which the valve actuating mechanism is compact and yet structurally effective to attain a reduction in size and in cost of the mechanism.

A further object of the present invention is to provide a lubricating system for an OHC type four-valve actuating mechanism in an internal combustion engine of a simple construction and capable of supplying lubricating oil precisely, consistently and forcibly to each portion required to be lubricated of the valve actuating mechanism.

The preferred embodiment of the present invention is illustrated in the accompanying drawings, wherein:

FIG. 6 is a sectional elevation view taken substantially on the line IV—IV in FIG. 1 and illustrating another portion of the lubricating system.

FIG. 7 is an enlarged, fragmentary sectional elevation view taken substantially on the line VII—VII in FIG. 1 and illustrating another portion of the lubricating system.

FIG. 8 is an elevation view of the cam shaft holder removed from the engine for clarity.

FIG. 9 is a bottom view of the cam shaft holder of FIG. 8.

While the present invention will be described in detail with respect to a specific embodiment thereof incorporated in an in-line engine with all of the cylinders in a single row rather than a V-type or other type engine, and with specific components of one conventional type engine, it will readily appear to those skilled in the art that the invention is equally applicable and adaptable to various other engine types and components.

Figure 2:
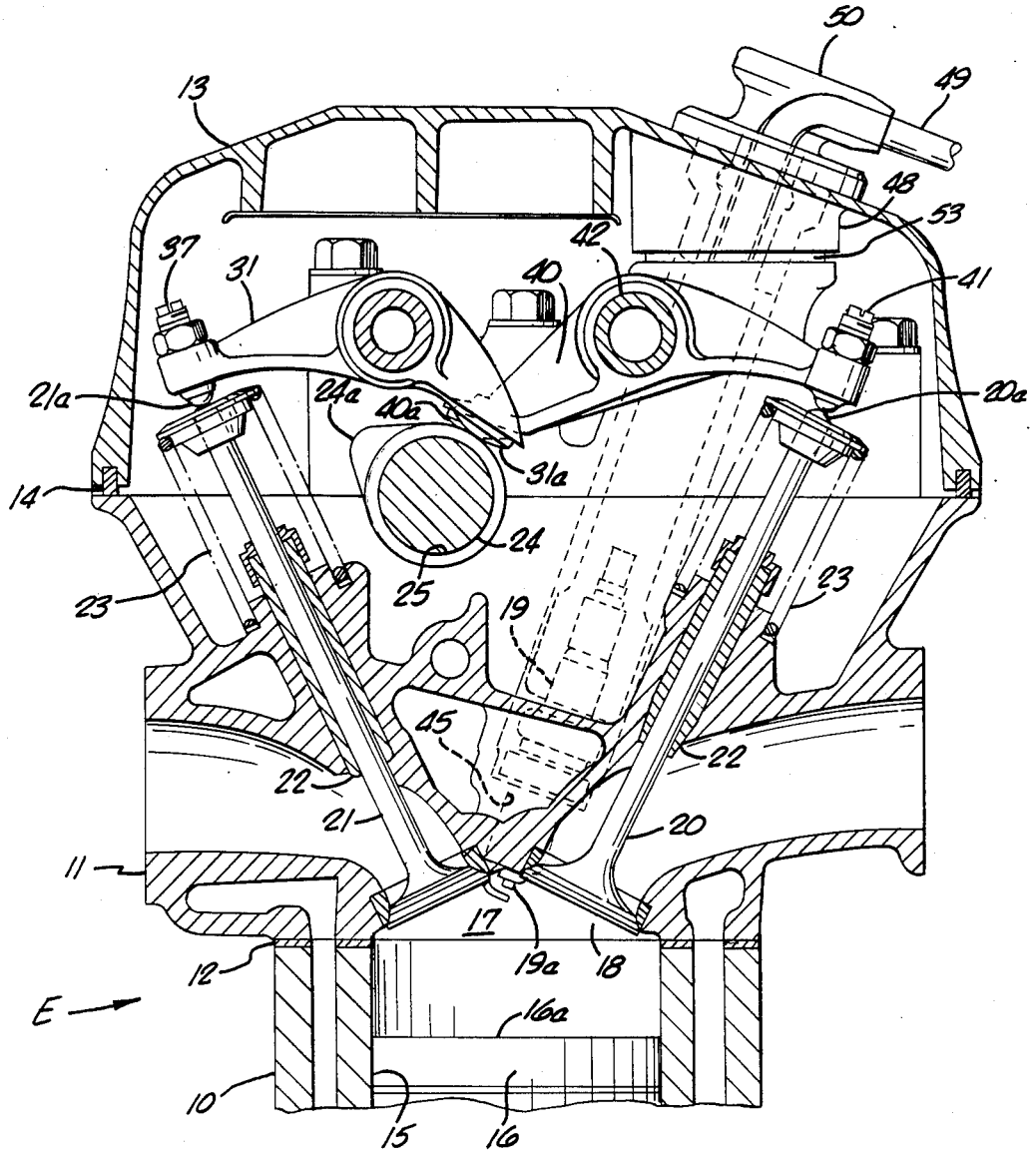
FIG. 2 is a sectional elevation view taken substantially on the line II—II in FIG. 1 with some components shown in elevation for clarity of illustration.

Referring now in detail to FIG. 2 of the drawings, an internal combustion engine body E for an in-line, OHC engine includes a cylinder block 10 and a cylinder head 11 attached thereto in sealed relation through a gasket 12. A valve cover 13 is mounted on top of the cylinder head 11 in sealed relationship through a gasket 14. A plurality of cylinders 15 are provided in the cylinder block 10 in a longitudinal row. A piston 16 is provided in each cylinder 15 and connected to a crankshaft (not shown) in the conventional manner to reciprocate within the cylinder 15. A combustion chamber 17 is formed between the top surface 16a of the cylinder and a ceiling 18 formed in the cylinder head 11. A spark plug 19 is mounted in cylinder head 11 in a manner described more fully hereinafter and has its electrodes 19a positioned in approximately the center of the ceiling 18 of the combustion chamber 17 to provide the most desirable location for ignition of the combustible mixture. A pair of intake valves 20 are positioned to one side of the center of each cylinder and a pair of exhaust valves 21 are positioned to the other side with the faces of the four valves 20 and 21 comprising a portion of the ceiling 18 of the combustion chamber 17 when the valves are closed. Although it is not essential to this invention, the intake valves 20 may be larger than the exhaust valves 21 for enhancing the intake of the fuel-air mixture into the cylinder 15. Each of the valves 20 and 21 is slidably mounted in its own valve guide 22 and continually urged toward a closed position by a spring 23 in a conventional manner.

A cam shaft 24 is rotatably mounted on the cylinder head 11 by semi-cylindrical bearings 25 formed at longitudinally spaced locations in the top of the cylinder head 11 at the location of each cylinder and at each extreme end of the cylinder head. Conventional bearing caps 35 are provided at each extreme end of the cylinder head to cooperate with the bearing portions 25 to rotatably support the ends of the cam shaft 24. A downwardly facing semi-cylindrical bearing surface 26 is provided in cam shaft holders 27 to rotatably support and confine the cam shaft 24. A cam shaft holder 27 is provided above each cylinder 15 and is mounted to the cylinder head by three bolts 28, 29 and 30. The cam shaft 24 is provided with four cam lobes 24a for each cylinder to engage each of the four rocker arms, as described below that actuate each of the four valves 20 and 21 for each cylinder.

Figure 1:
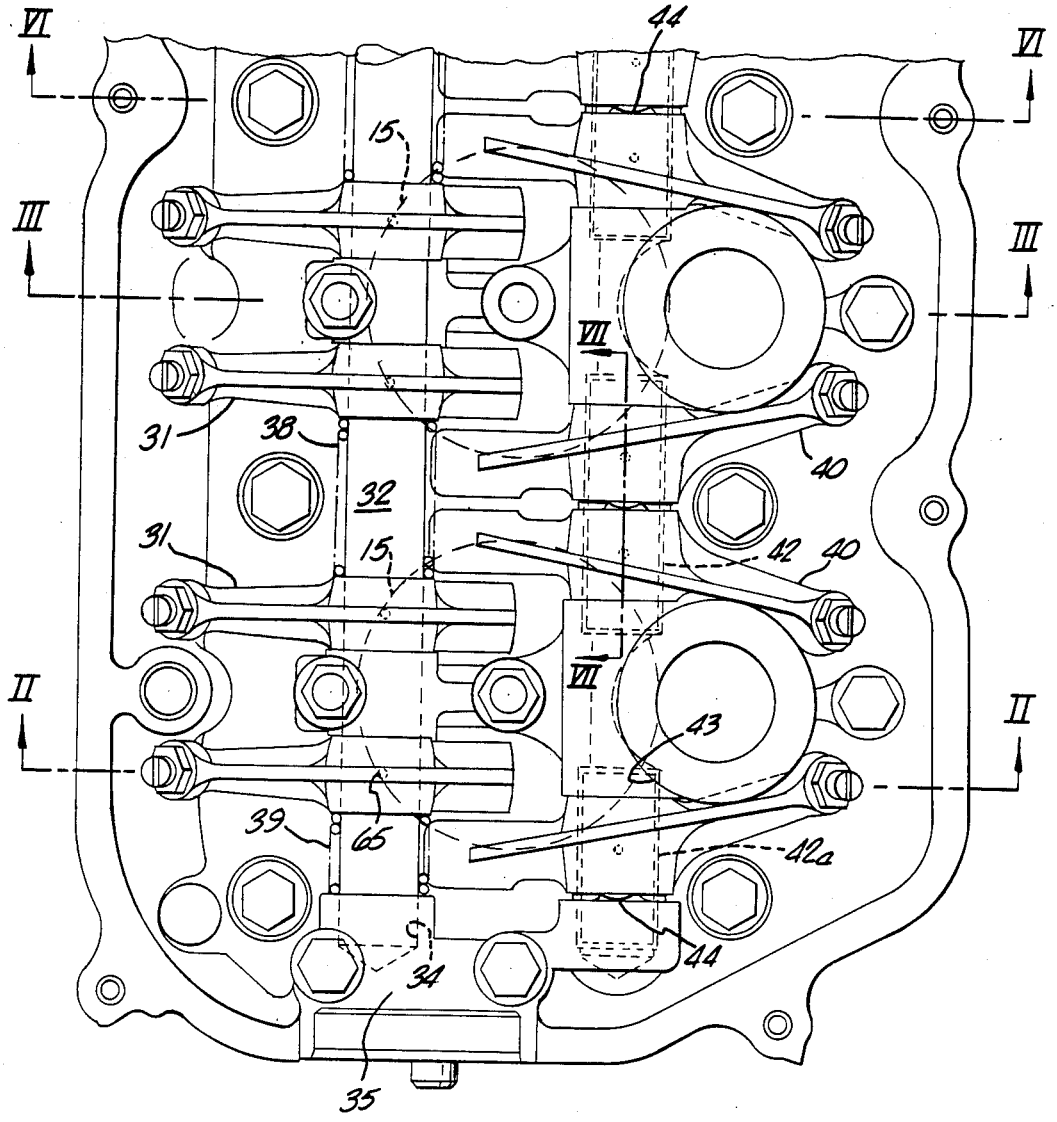
FIG. 1 is a top plan view of a portion of an internal combustion engine having the valve actuating mechanism of this invention with the valve cover removed.
Figure 3:
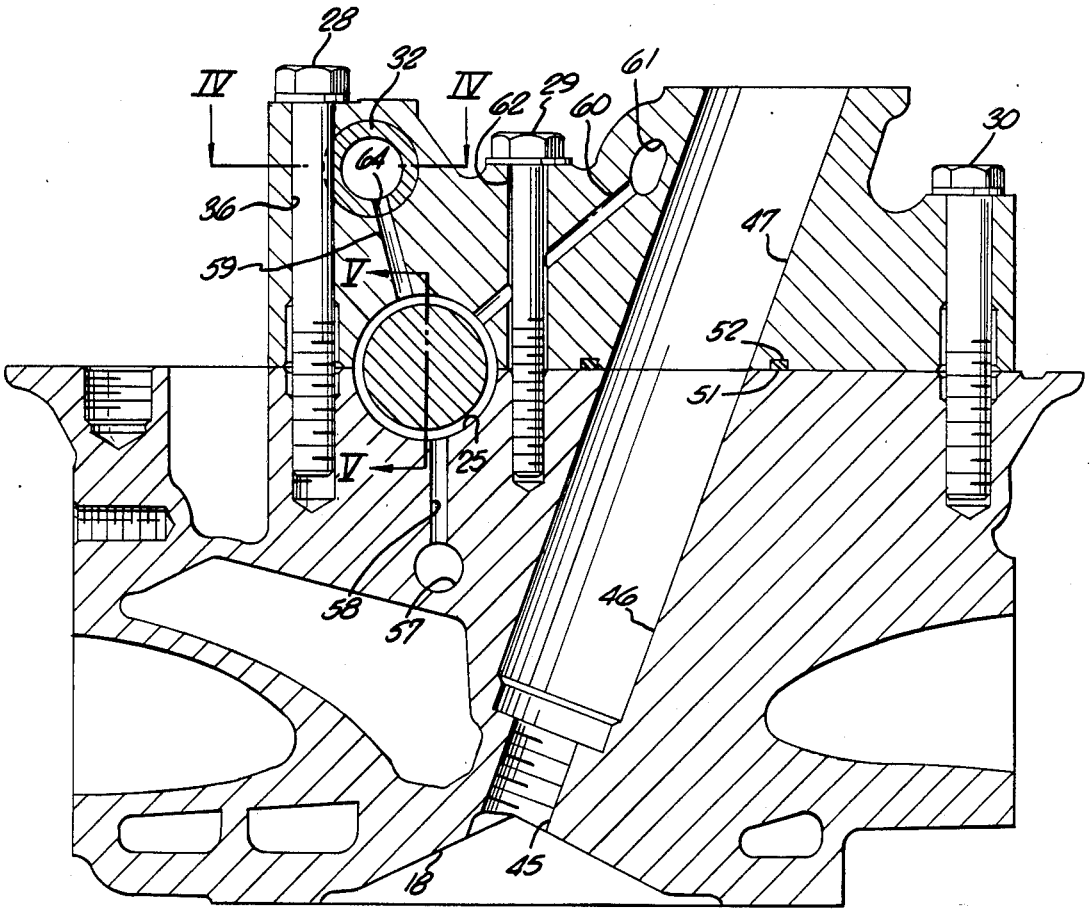
FIG. 3 is a sectional elevation view taken substantially on the line III—III in FIG. 1.
Figure 5:
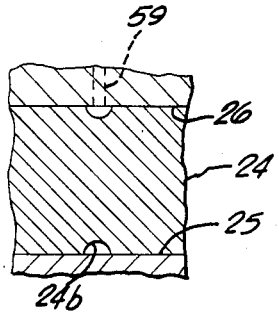
FIG. 5 is an enlarged, fragmentary sectional plan view taken substantially on the line V—V in FIG. 3 and illustrating another portion of the lubricating system.
Figure 4:
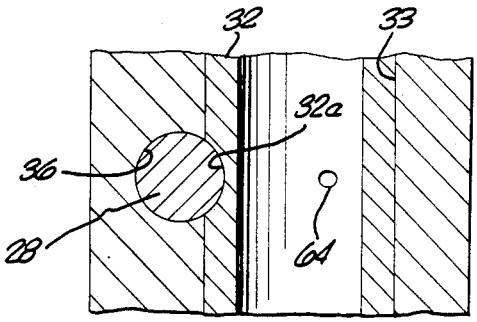
FIG. 4 is an enlarged, fragmentary sectional plan view taken substantially on the line VI—VI in FIG. 3 and illustrating a portion of the lubricating system.

Each of the exhaust valves 21 is actuated by a rocker arm 31 that is pivotally supported on a rocker arm shaft 32 extending the length of the engine. Rocker arm shaft 32 is supported in a bore 33 provided in the longitudinal direction through each cam shaft holder 27 and a blind hole 34 in the end bearing caps 35. The bore 33 and vertical hole 36 for bolt 28 in each cam shaft holder 27 may intersect, as shown in FIGS. 3 and 4, and the rocker arm shaft 32 be provided with an external notch 32a at the location of each bolt 28 to prevent rotational or longitudinal movement of the rocker arm shaft 32 relative to the cam shaft holders 27. Each rocker arm 31 is provided with a slipper portion 31a for engaging the exterior of the cam shaft 24 and being moved by the lobe 24a. Further, each rocker arm 31 has an adjustment screw 37 on its opposite end for engaging the top 21a of the exhaust valve 21 in a relatively conventional manner. As shown in the plan view FIG. 1, the exhaust valve rocker arms 31 are positioned immediately adjacent the cam shaft holders 27 and extend substantially straight from the point of engagement with the cam shaft 24 to the point of engagement with the top 21a of the exhaust valve 21. A compression spring 38 surrounds the rocker arm shaft 32 and extends between the rocker arms 31 of adjacent cylinders to resiliently maintain the proper longitudinal position of the rocker arms. Similarly, a compression spring 39 extends between the last rocker arms 31 and the end bearing caps 35.

Each of the intake valves 20 is actuated by a rocker arm 40 pivotally supported in a manner hereinafter described for a slipper portion 40a to engage the cam shaft 24 and be pivoted by a cam lobe 24a with an adjustment screw 41 on the opposite end engaging the top 20a of the intake valve 20 for actuating that valve. Each intake rocker arm 40 is pivotally supported on a short shaft 42 with adjacent rocker arms 40 of adjacent cylinders 15 being mounted on a single short shaft 42 while the rocker arms 40 at the extreme ends of the engine are separately mounted on a separate short shaft 42a supporting only a single rocker arm 40. Each short shaft 42 has its ends supported by two different cam shaft holders 27 by means of the countersunk bores 43 provided in each longitudinally facing side of each cam shaft holder 27. The end short shaft 42a has one end supported in a bore in the end bearing cap 35. As shown in plan view FIG. 1, the intake rocker arms 40 have a relatively straight portion extending from their pivotal mounting on the short shaft 42 to the slipper portion 40a engaging the cam shaft 24 but have an angled portion extending to the top 20a of the intake valve 20 since the rocker arms 40 are pivotally supported at a location offset from the locations of the intake valves 20. The pivotal support of rocker arms 40 by the short shaft 42 is extremely stable and accurate since each short shaft 42 is supported at both ends rather than being cantilevered from a bracket. The use of a plurality of short shafts 42 as the intake rocker arm support means rather than a single continuous shaft similar to the exhaust valve rocker arm shaft 32 is necessary to provide space between the intake valves for the spark plug and access to the spark plug. However, structural integrity is not sacrificed by the arrangement of this invention. A spring washer 44 is provided on the rocker arm shafts 42 and 42a between each pair of adjacent rocker arms 40 and between the end bearing caps 35 and the last rocker arm 40 for resiliently maintaining the proper longitudinal position of the rocker arms 40.

The spark plug 19 is threadedly mounted in a bore 45 in the cylinder head 11 located at the center of the ceiling 18 to position the spark plug electrodes 19a at the center of the combustion chamber 17 for the best ignition performance, as noted above. The threaded bore 45 and the enlarged upward extension bore 46 thereof are inclined at an angle to the vertical but in a plane perpendicular to the longitudinal axis of the engine. Another cylindrical bore 47 is provided in the cam shaft holder 27 of the same size and in axial alignment with the bore 46 to extend even further upwardly. A tubular boss 48 is provided in the valve cover 13 in alignment with the bores 45, 46 and 47 whereby access to the spark plug 19 is possible from outside the valve cover 13. An ignition wire 49 is connected to the spark plug through a cap 50 that mates with the tubular boss 48 to enclose the axis opening to the spark plug. The bores 45, 46 and 47 may be positioned at any convenient angle to miss the other components of the valve actuating mechanism but it is preferred that the spark plug be as close to vertical as possible. In the embodiment illustrated the spark plug axis bores 46 and 47 are at approximately 20 degrees from vertical. An O-ring 51 is positioned in the groove 52 in the bottom surface of the cam shaft holder 27 and surrounds the bores 46 and 47 to seal those bores from the interior of the valve cover 13 and cylinder head 11 to exclude lubricating oil. A gasket 53 is provided between the boss 48 and the top surface of the cam shaft holder 27 surrounding the bore 47 to similarly seal the interior of bore 47 from the interior of the valve cover 13. It should be noted that the bore 47 intersects the longitudinal projection of the multiple rocker arm short shafts 42 which, as previously noted, is the reason for using a series of short shafts rather than a single shaft that would interfere with the desired location of the spark plug and access to the spark plug.

Lubrication of the aforedescribed valve actuating mechanism is provided in a convenient and unique manner which will now be described. An oil supply passage 54 in the cylinder block 10 from the conventional oil pump (not shown) communicates with a vertical passage 55 and lateral horizontal passage 56 and in turn to a longitudinally extending main oil passage 57 in the cylinder head 11. The main oil passage 57 is immediately below and parallel to the cam shaft 24 and riser ports 58 connect the main oil passage 57 to each semicylindrical bearing portion 25 rotatably supporting the cam shaft 24. At least one of the cam shaft holders 27, for example, one of the cam shaft holders toward the middle of the engine, is provided with a port 59 extending from the cam shaft bearing surface 26 to the bore 33 that supports the rocker arm shaft 32 and another port 60 extending from bearing portion 26 to a passage 61 extending between the longitudinally facing bores 43 that support the rocker arm short shafts 42. Port 60 actually intersects the bore 62 for mounting bolt 29 but an annular space or clearance is provided between the bolt 29 and bore 62 for allowing the lubricating oil to flow pass that location from the bearing portion 26 to the passage 61 in the cam shaft holder 27. The short shafts 42 are tubular, as shown in FIG. 7, to communicate the lubricating oil throughout the length of the intake valve rocker arm shaft means comprised of the short shafts 42 and cam shaft holders 27. The short shafts 42 are provided with radial ports 63 for communicating the lubricating oil to the bearing surface between the short shafts 42 and the rocker arms 40. The continuous rocker arm shaft 32 is tubular and is provided with a port 64 in alignment with port 59 for supplying lubricating oil to the interior of the shaft 32. Shaft 32 is provided with a port 65 at the longitudinal location of each rocker arm 31 to lubricate the bearing surface between the rocker arm shaft 32 and each rocker arm 31. The cam shaft 24 is provided with a circumferential groove **24*b* at the location of the oil ports 59 and 60 of the cam shaft holder 27 to conduct the lubricating oil from the riser port 58 to the ports 59 and 60. In this manner, the cam shaft 24 and all of the rocker arms 31 and 40** are forcibly and continuously lubricated.

Thus, according to this invention, a valve actuating mechanism is provided that employs a single overhead cam for operating rocker arms to actuate four valves for each cylinder and yet the spark plug is properly located with its electrodes in the center of the combustion chamber and is accessible for routine maintenance without removal of any of the valve actuating mechanism or valve cover. The rocker arms are supported in a structurally reliable manner through a single rocker arm shaft for all of the exhaust valve rocker arms and a plurality of short shafts for all of the intake valve rocker arms with each such short shaft being supported from both ends. Further, a lubricating system is provided for lubricating the cam shaft and each of the rocker arms from the inside of the rocker arm shafts with pressurized lubricating oil.

The invention claimed is:

1. In a four-valve, overhead cam internal combustion engine having plural cylinders in a line and a pair of valves on each side of said line for each said cylinder, a valve actuating apparatus, comprising: a single cam shaft rotatably mounted between said pairs of values above and extending longitudinally along said line of cylinders, a first rocker arm shaft means mounted parallel to said cam shaft and having a plurality of rocker arms pivotally mounted thereon and engaging said cam shaft for actuating the pairs of valves on one side of the line of cylinders, a second rocker arm shaft means mounted parallel to said cam shaft and having a plurality of rocker arms pivotally mounted thereon and engaging said cam shaft for actuating the pairs of valves on the other side of the line of cylinders, said second rocker arm shaft means including a plurality of separate short shafts with each short shaft pivotally supporting two rocker arms of which one rocker arm operates one valve for one cylinder and the other of said two rocker arms operates one valve for an adjacent cylinder, each said short shaft having two ends which are supported in spaced relation from the ends of each adjacent short shaft, and means mounted directly above each cylinder for supporting each of the two ends of each short shaft with said rocker arms pivotally supported thereon between said ends.

2. The apparatus of claim 1 wherein said support means includes a cam shaft holder mounted directly above each cylinder with longitudinally facing bores on each side for receiving and supporting the respective ends of two said short shafts.

3. The apparatus of claim 2 wherein said short shafts are tubular and passage means connect the two said longitudinally facing bores of each said cam shaft holder for conducting lubricating oil to all the short shafts and thereby the entire said second rocker arm means.

4. The apparatus of claim 3 wherein each said cam shaft holder includes port means for conducting lubiricating oil to said passage means.

5. The apparatus of claim 2 including a plurality of longitudinally spaced cam shaft holders overlying said cylinders and wherein each said cam shaft holder includes a longitudinally extending bore therethrough for receiving and supporting said first rocker arm shaft means.

6. The apparatus of claim 5 wherein, said first rocker arm means is tubular, and at least one of said cam shaft holders includes port means for conducting lubircating oil to the interior of said tubular first rocker arm means.

7. The apparatus of claim 2 wherein said cam shaft holder includes a spark plug mounting means for mounting a spark plug at approximately the center of the top of the cylinder, said spark plug mounting means providing access to the spark plug on the side of and between the pair of rocker arms for that cylinder that are pivotally supported on said short shafts.

8. The apparatus of claim 7 wherein said spark plug mounting means includes an inclined tubular portion extending partially between the ends of adjacent short shafts.

9. The apparatus of claim 7 wherein each said cam shaft holder includes a longitudinally extending bore therethrough for receiving and supporting said first rocker arm shaft means.

10. The apparatus of claim 1 including a cam shaft holder mounted directly above each cylinder, said cam shaft holder comprising a bearing cap for rotatably supporting said cam shaft, mounting means for supporting both the first rocker arm shaft means and the said ends of the short shafts of the said second rocker arm shaft means, and an access opening for a spark plug mounting means.

11. The apparatus of claim 1, wherein a spring washer is provided on each said short shaft between said two rocker arms mounted on that short shaft for resiliently urging said rocker arms against said supporting means.

12. In an OHC four-valve actuating apparatus of an internal combustion engine having a cylinder head and plural cylinders in a line with a pair of exhaust valves on one side of the line of cylinders and a pair of intake valves on the other side for each cylinder, a cam shaft above the cylinders, rocker arms and rocker arm shaft means for actuating the valves from the cam shaft, the improvement comprising, a separate cam shaft holder mounted a top the cylinder head directly above each cylinder and extending laterally of the line of cylinders, said cam shaft holder having means for partially encircling the cam shaft and supporting the rocker arm shaft means, and said cam shaft holder having an opening therethrough for access to a spark plug mounting for the cylinder below that cam shaft holder.

13. The apparatus of claim 12, wherein said cam shaft holder includes passages therein for receiving lubricating oil from the engine and conducting the lubricating oil to the rocker arm shaft means for lubricating the rocker arms.

14. The apparatus of claim 12, wherein the rocker arm shaft means for the rocker arms for the intake valves is comprised of a plurality of short shafts with each said short shaft extending between and supported at both ends by a pair of said cam shaft holders.

15. The apparatus of claim 14, wherein said spark plug mounting opening in each said cam shaft holder has a portion located between the ends of the short shafts supported by that cam shaft holder,

16. The apparatus of claim 14, wherein a spring washer is mounted on each said shaft between a pair of rocker arms on said short shaft for resiliently urging said rocker arms away from each other.

* * * * *

UNITED STATES PATENT AND TRADEMARK OFFICE

CERTIFICATE OF CORRECTION

PATENT NO. : 4,773,361

DATED : September 27, 1988

INVENTOR(S) : Susumu Toki, Takeshi Iwata, Noriaki Fujii

It is certified that error appears in the above-identified patent and that said Letters Patent is hereby corrected as shown below:

Column 5, line 68 change "values" to --valves--.

Signed and Sealed this

Twentieth Day of March, 1990

*Attest:*

JEFFREY M. SAMUELS

*Attesting Officer*

*Acting Commissioner of Patents and Trademarks*